US007640997B2

(12) United States Patent
Bram et al.

(10) Patent No.: US 7,640,997 B2
(45) Date of Patent: Jan. 5, 2010

(54) BREAKER TOOL WITH VIBRATION DAMPED HANDLE DEVICE

(75) Inventors: Ernst Arne Johan Bram, Kalmar (SE); Magnus Liebert Gustavsson, Läckeby (SE)

(73) Assignee: Atlas Copco Construction Tools AB, Nacka (SE)

( * ) Notice: Subject to any disclaimer, the term of this patent is extended or adjusted under 35 U.S.C. 154(b) by 0 days.

(21) Appl. No.: 11/915,570

(22) PCT Filed: May 24, 2006

(86) PCT No.: PCT/SE2006/000603

§ 371 (c)(1),
(2), (4) Date: Nov. 26, 2007

(87) PCT Pub. No.: WO2006/126944

PCT Pub. Date: Nov. 30, 2006

(65) Prior Publication Data

US 2008/0196913 A1 Aug. 21, 2008

(30) Foreign Application Priority Data

May 26, 2005 (SE) ..... 0501182

(51) Int. Cl.
*B25D 17/04* (2006.01)

(52) U.S. Cl. ..... 173/162.2

(58) Field of Classification Search ..... 173/162.2; 403/225; 16/431, 225, 239
See application file for complete search history.

(56) References Cited

U.S. PATENT DOCUMENTS 2,629,364 A * 2/1953 Anderson ..... 403/81
3,637,029 A * 1/1972 Sherwood et al. ..... 173/162.2
4,060,138 A * 11/1977 Cox et al. ..... 173/49
4,576,241 A * 3/1986 Emonet ..... 173/162.2
4,673,043 A 6/1987 Greppmair
4,718,502 A * 1/1988 Garcez ..... 173/171
5,025,870 A * 6/1991 Gantner ..... 173/162.2
5,027,910 A * 7/1991 Honsa et al. ..... 173/162.2
5,749,421 A * 5/1998 Johansson et al. ..... 173/162.2
5,921,327 A * 7/1999 Henriksson et al. ..... 173/210

(Continued)

FOREIGN PATENT DOCUMENTS

FR 2 581 337 A1 11/1986

(Continued)

*Primary Examiner*—Brian D Nash
(74) *Attorney, Agent, or Firm*—Frishauf, Holtz, Goodman & Chick, P.C.

(57) ABSTRACT

A breaker tool has a chassis carrying a motor, an impact mechanism operating in a certain working direction, an enclosure rigidly connected to the chassis and surrounding at least the motor, and a handle device including two handles protruding from opposite sides of the enclosure and are vibration damped relative to the chassis via swing arms, where the swing arms are arranged to accomplish a flexible parallel movement providing coupling between the chassis and the handle device. The handle device includes a bridge to which the handles are secured. The swing arms are pivotally connected to the bridge via first pivots and to the chassis via second pivots, where at least one of the first and second pivots is a torsion pivot that provides a limited torsion damped oscillation of the bridge relative to the chassis in a direction substantially parallel with the working direction.

8 Claims, 6 Drawing Sheets

U.S. PATENT DOCUMENTS

| | | | | |
|---|---|---|---|---|
| 5,947,211 | A * | 9/1999 | Jakobsson | 173/210 |
| 6,112,831 | A * | 9/2000 | Gustafsson | 173/162.2 |
| 7,404,452 | B2 * | 7/2008 | Malkin et al. | 173/162.2 |
| 2003/0132016 | A1 | 7/2003 | Meixner et al. | |
| 2003/0175078 | A1 | 9/2003 | Sina et al. | |
| 2004/0231867 | A1 | 11/2004 | Becht et al. | |
| 2005/0050690 | A1 * | 3/2005 | Oddo et al. | 16/431 |
| 2007/0144750 | A1 * | 6/2007 | Buchenau et al. | 173/162.2 |
| 2008/0099219 | A1 * | 5/2008 | Schmid et al. | 173/90 |
| 2008/0185163 | A1 * | 8/2008 | Becht et al. | 173/162.2 |
| 2008/0289842 | A1 * | 11/2008 | Chapple et al. | 173/162.2 |

FOREIGN PATENT DOCUMENTS

| | | |
|---|---|---|
| GB | 1 549 771 | 8/1979 |

* cited by examiner

BREAKER TOOL WITH VIBRATION DAMPED HANDLE DEVICE

This application is a U.S. National Phase Application under 35 USC 371 of International Application PCT/SE2006/000603 filed May 24, 2006.

TECHNICAL FIELD

The invention relates to a breaker tool that comprises a chassis and a motor mounted thereon, an impact mechanism driven by the motor and arranged to operate in a certain working direction, a enclosure which surrounds at least the motor, and a handle device comprising two handles protruding at opposite sides of the enclosure and being vibration damped relative to the chassis via swing arms, wherein the swing arms are arranged to accomplish a flexible connection for parallel movement between the chassis and the handle device.

PRIOR ART

A breaker tool according to the preamble is previously described in U.S. Pat. No. 4,673,043. One of the advantages with the breaker tool described in this publication is that the handle thanks to swing arms is well vibration damped as to movements originating from the impact work performed by the breaker tool. A disadvantage is that the breaker tool is comparatively bulky due to the fact that the surrounding enclosure has to be large enough to allow primarily the vibration movements of the motor relative to the handles which are mounted on the enclosure.

SUBJECT OF THE INVENTION

Regarding the above background the subject with the invention is to provide a breaker tool which is as well vibration damped as the tool according to U.S. Pat. No. 4,673,043 as regard movements originating from the breaker tool impact movements but being more compact and easier to handle than that tool.

BRIEF SUMMARY OF THE INVENTION

According to the invention the above subject is accomplished in a breaker tool described in the preamble in that the enclosure is connected to the chassis, that the handle device comprises a bridge which extends across the chassis inside the enclosure and carrying the handles, that the swing arms are pivotally connected to the bridge via first pivots and to the chassis via second pivots, whereof at least one of the pivots is a torsion pivot which provides a limited torsion damped swinging movement of the bridge substantially parallel with the working direction.

By forming the handle device as a bridge located inside the enclosure in accordance with the invention the enclosure may surround the motor in quite tightly which means that the dimensions of the enclosure may be considerably reduced compared to previous tools. Thanks to the tighter enclosure and the rigid mounting of the enclosure it is also possible to integrate the enclosure in a necessary motor cooling fan system and to use the enclosure for guiding an air flow from the fan system to accomplish clean blowing of the working area of the breaker tool. The advantage with the solution comprising at least one torsion pivot is that such a pivot has a low weight as well as a defined centre position from which pivoting in two opposite directions is possible.

Preferably, the torsion pivot comprises a cylindrical elastomeric bush which has a core rotationally locked to the respective swing arm, and a mantle which is rotationally locked to chassis and the bridge. As an alternative, the torsion pivot may comprise a cylindrical elastomeric bush with a mantle which is rotationally locked to the respective swing arm, and a core that is rotationally locked to the chassis and the bridge, respectively. One of the advantages with these two solutions is that the elastomeric bush apart from its torsion properties also provides a certain elasticity which contributes to keep away vibrations from the handles.

Preferably, a first pair of parallel swing arms are arranged on opposite sides of the chassis, and a second pair of parallel swing arms are arranged on opposite sides of the chassis, such that these pairs, in relation to the working direction, are located on opposite sides of the handles. The advantage gained by this is that such a solution results in an even load on the swing arms of the handle device and also an even vibration damping along the entire movement range of the handle device.

Suitably, one of the first and second pairs of parallel swing arms rotationally locked to a common rod which is rotationally locked to the core of the respective elastomeric bush. Such a solution is advantageous primarily by strength reasons, because a rod which is common to two swing arms is able to distribute forces in a better way than separate stub axles.

According to first alternative, the breaker tool comprises a combustion engine having a fuel tank preferably mounted on the bridge inside the enclosure. Apart from avoiding fuel leakage from a vibration damped tank it is desirable to have as big mass as possible on the bridge and handles in relation to the rest of the breaker tool so as to achieve an optimum vibration damping.

According to a second alternative the breaker tool comprises an electric motor with an electronic control unit mounted on the bridge inside the enclosure. The advantage gained by this is primarily to protect the impact sensitive electronics and to extend the service life of these parts.

Preferably, the electric motor is an electronically commutated permanent magnet motor which has a motor shaft with a crank arm which via a connecting rod operates the breaker tool impact mechanism. The advantage gained by using a permanent magnet motor is the fact that such a motor can provide power enough at low revs already thereby being able to operate the impact mechanism without any reduction gearing which would steal energy and form another vibration source.

BRIEF DESCRIPTION OF THE DRAWINGS

A preferred embodiment of the breaker tool according to the invention is described below in more detail with reference to the accompanying drawings in which.

DESCRIPTION OF THE PREFERRED EMBODIMENT

Figure 1:
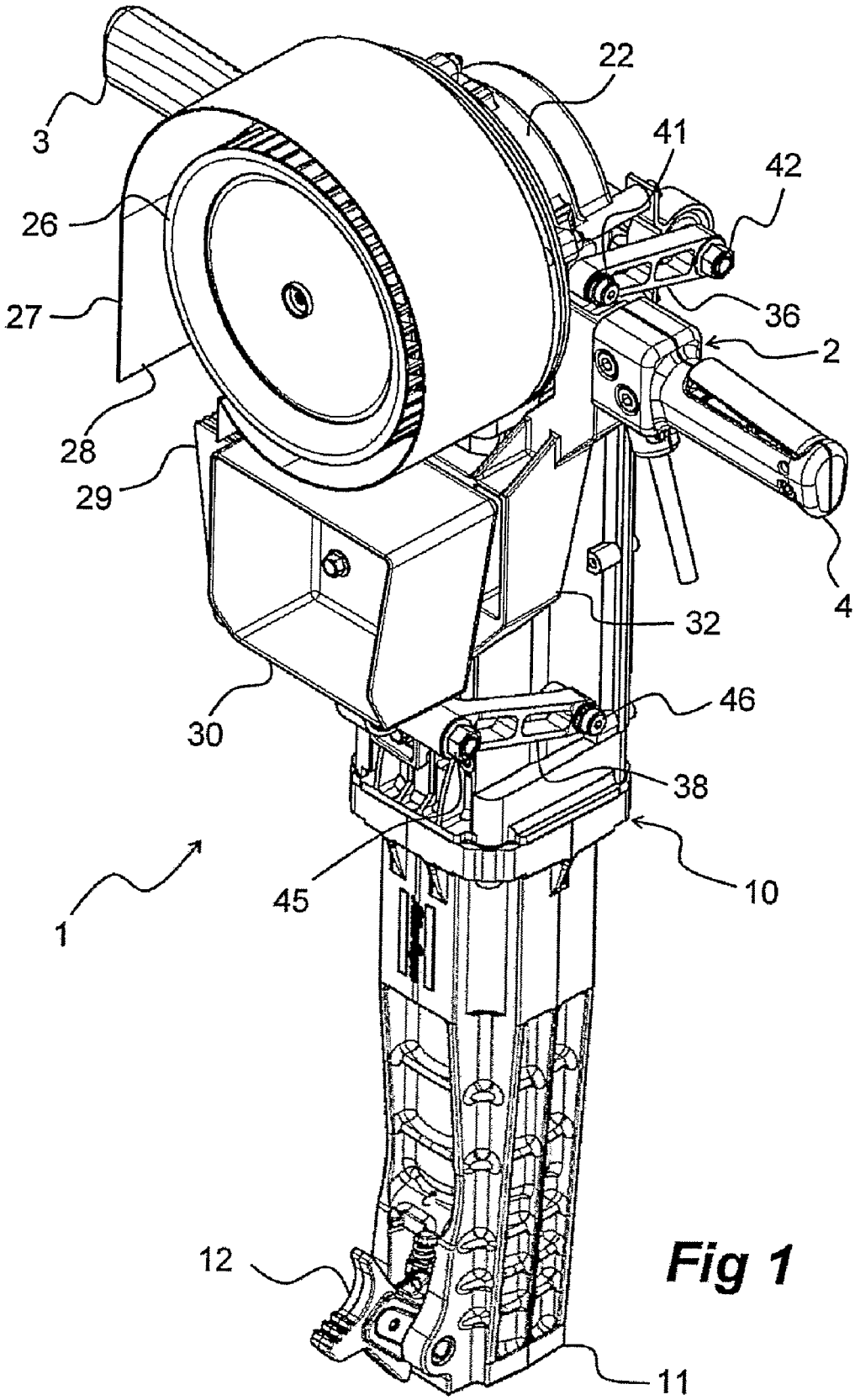
FIG. 1 is a perspective view at an angle from the front end of the breaker tool, wherein some details are left out to bring out the most important features of the invention.

Initially, it is to be pointed out that for the breaker tool 1 illustrated in the drawings, including handle device 2, the same reference numbers are used, but for the sake of clarity not all details are pointed out in all figures. Further, it is to be observed that expressions like at the front, right or below are based on the normal use of the breaker tool 1. In that position the operator stands behind the breaker tool 1 with his right hand on a handle 3 on the right hand side of the breaker tool 1, with his left hand on a handle 4 on the left hand side of the breaker tool 1 and with the working part of the breaker tool 1 directed downwards. Finally, it is to noted that of course the breaker tool 1 is intended for receiving a chisel in a known way, even though a chisel is not shown in the drawings. The chisel has a longitudinal axis defining a geometric tool axis a extending along the entire breaker tool 1. Finally, it is to be pointed out that during use of the breaker tool 1 parts of the tool shall be surrounded by a schematically illustrated enclosure 5, wherein the shape of the enclosure do not have to follow the contour indicated in the drawings.

The breaker tool 1 has a machine chassis 10 which at its lower part (referring to the drawing figures) defines a chisel support 11. In a known way a non-illustrated chisel, in the form of a moil point or flat chisel, is insertable and lockable by means of a latch handle 12.

Figure 5:
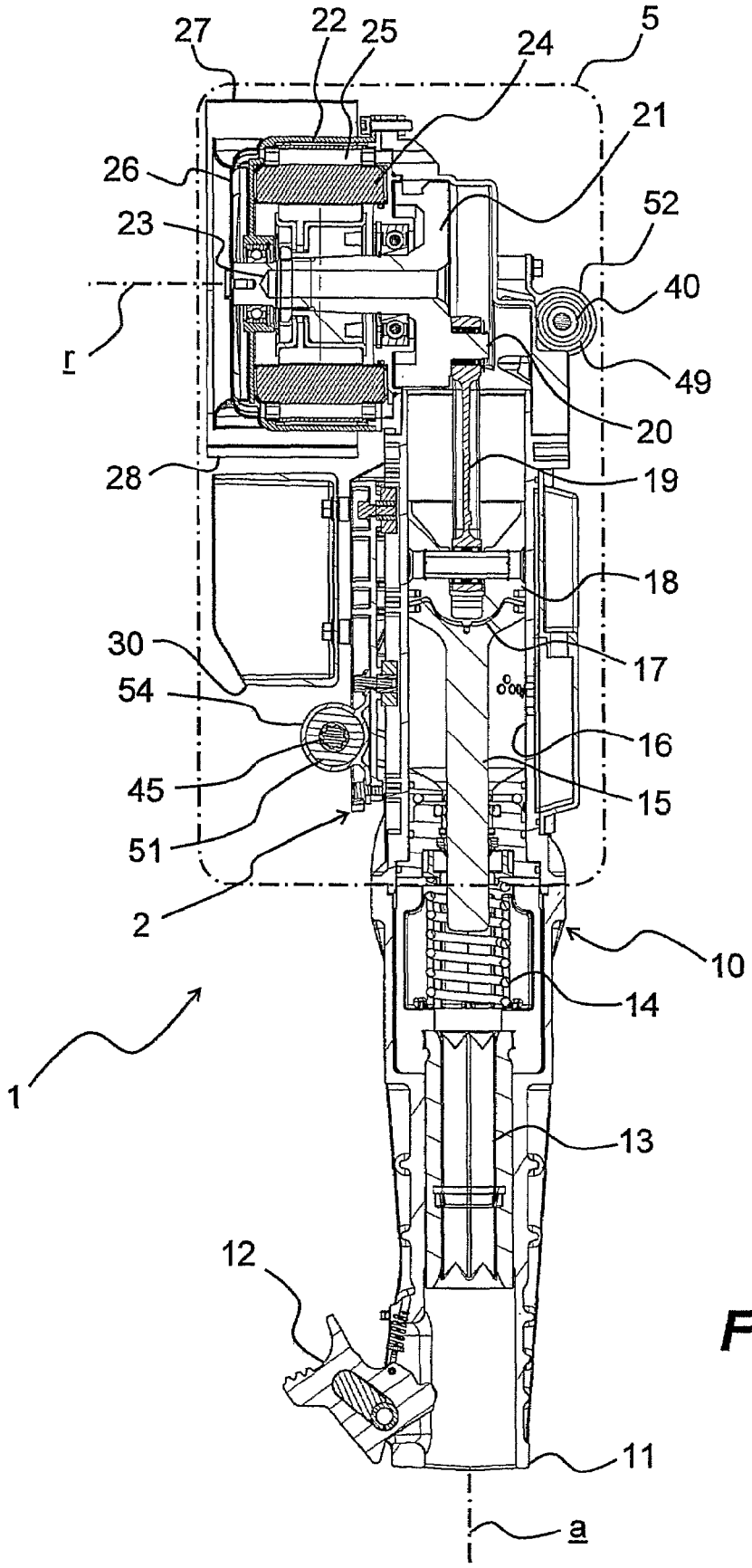
FIG. 5 is a cross sectional view of the left side of the breaker tool with the enclosure schematically illustrated.
Figure 6:
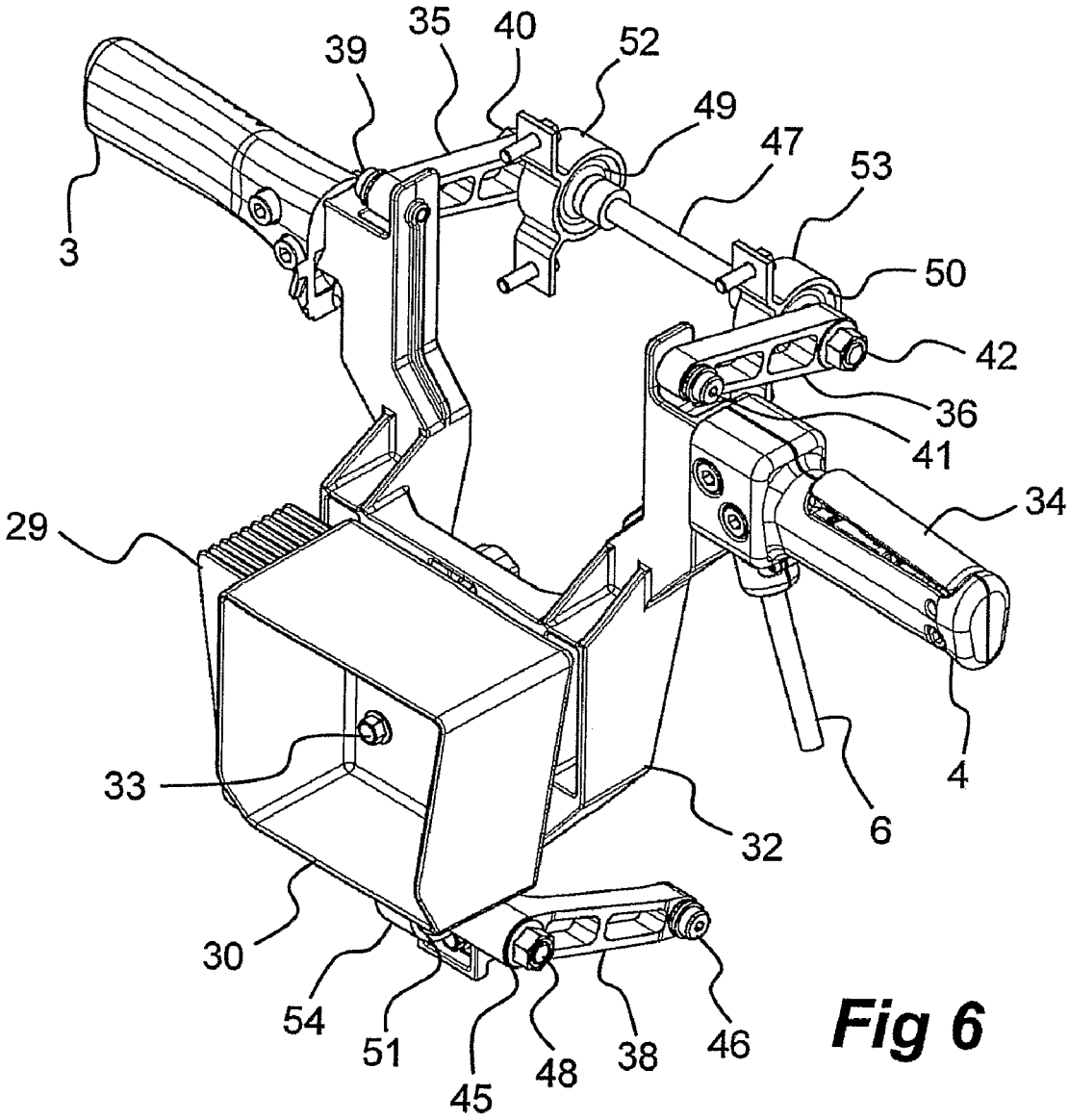
FIG. 6 is a perspective view at an angle from the front side of a handle device comprised in the breaker tool.

Inside the machine chassis 10 and adjacent the chisel support 11 there is, in a likewise known way, as shown in FIG. 5 a first stamp 13, a coil spring 14 and a second stamp 15. The second stamp 15 is guided in a cylinder 16 and activated via an air cushion 17 by a reciprocating piston 18. The piston 18 is driven in a reciprocating movement by a connecting rod 19 connected to a crank pin 20 on a flywheel 21 which defines a crank arm. The flywheel or crank arm 21 is rotated by an electric motor 22 having a motor shaft 23 defining a rotation axis X extending perpendicularly to the tool axis a.

Figure 2:
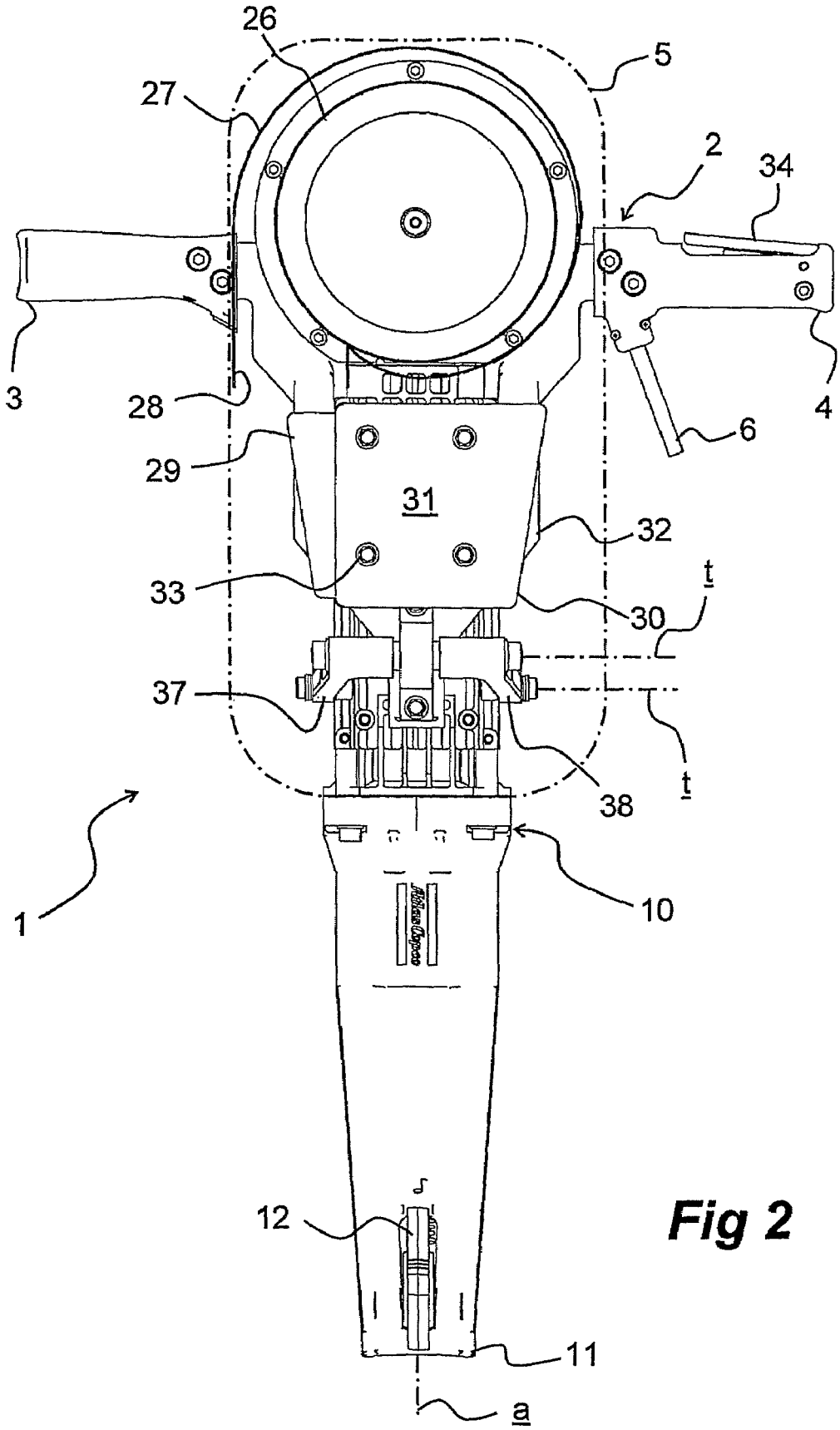
FIG. 2 is a front side horizontal view of the breaker tool with the enclosure schematically illustrated.
Figure 3:
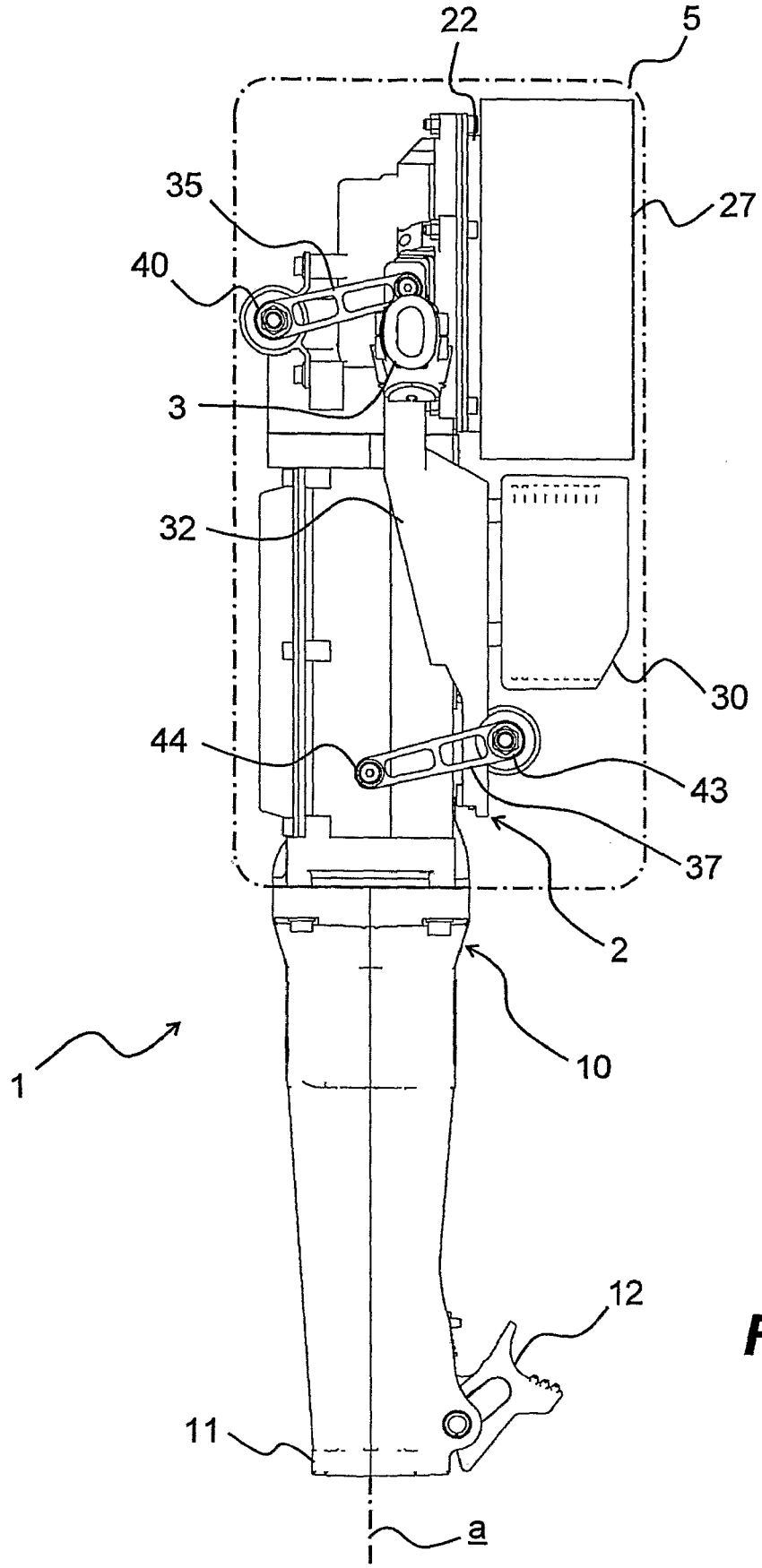
FIG. 3 is a horizontal view of the right side of the breaker tool with the enclosure schematically illustrated.
Figure 4:
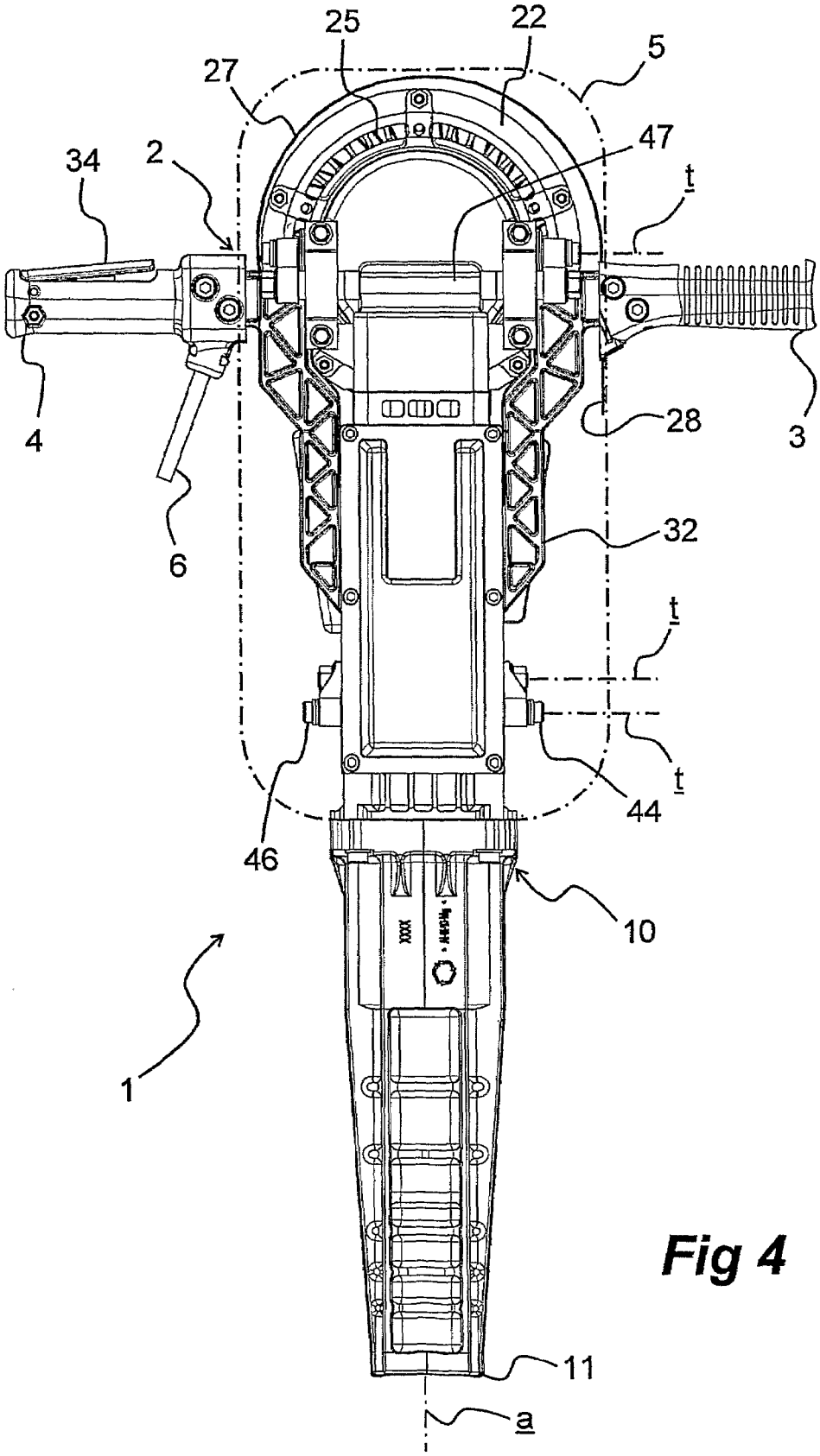
FIG. 4 is a horizontal view of the rear side of the breaker tool with the enclosure schematically illustrated.

The drive motor 22 is an electronically commutated permanent magnet motor with a stator 24 surrounded by air passages 25 through which cooling air is sucked by a fan wheel 26. This is mounted on the flywheel opposite end of the motor shaft 23 and is surrounded by spiral-shaped fan enclosure 27. Relative to the fan wheel 26 this enclosure 27 has a downwardly towards the chisel support 11 directed opening 28 and is intended to be completed by the above mentioned enclosure 5. Outside the opening 28 there are a number of cooling fins 29 which extend in parallel with the tool axis a and are mounted a control box 30 located below the drive motor 22. In the control box 30 a motor control unit is located and cooled by the cooling fins 29. The motor control unit is not illustrated in the drawings but in FIG. 2 it is indicated by the numeral 31. The purpose of the motor control unit 31 is to accomplish in a known way an electronic commutation of the drive motor 22 via cables (not shown).

For the purpose of vibration damping the control box 30 with its outer cooling fins 29 and the enclosed control unit 31 is mounted on the above mentioned handle device 2, or more precisely: on a bridge 32 forming part of the handle device 2. Viewed from the rear or front side of the breaker tool 1 the bridge 32, which is a cast detail, is substantially U-shaped having its U-legs located at opposite sides of the machine chassis 10 in level with the cylinder 16 and directed upwards and away from the chisel support 11. On the U-centre of the bridge 32 which extends across the machine chassis 10 the control box 30 is secured with screws 33, and on the U-legs in level with the drive motor 22 the right and left handles 3,4 are arranged so as to protrude from the respective U-leg perpendicularly relative to the tool axis a and the rotation axis L of the motor 22 on opposite sides of the machine chassis 10. The left handle 4 includes a lever 34 arranged to control a switch (not shown) for on-off control of the motor current. In the illustrated embodiment of the breaker tool 1 the motor current is supplied from a 240 V single-phase current source via a 10 A fuse and a cable 6 are connected to the left handle 4.

The bridge 32 is vibration damped relative to the machine chassis 10 via four swing arms 35-38. One of these, the upper right swing arm 35 is pivotally connected to the bridge 32 via a first pivot 39 at the right handle 3 and to the machine chassis 10 via a second pivot 40. An upper left swing arm 36 is pivotally connected to the bridge 32 via a first pivot 41 at the left handle 4 and to the machine chassis 10 via a second pivot 42. A lower right swing arm 37 is pivotally connected to bridge 32 via a first pivot 43 below the control box 30 and to the machines chassis 10 via a second pivot 44, whereas a lower left swing arm 38 is pivotally connected to the bridge 32 via a first pivot 45 below the control box 30 and to the machine chassis 10 via a second pivot 46.

Of the pivots the first pivots 39,41 of the upper swing arms 35,36 and the second pivots 44,46 of the lower swing arms 37,38 are formed by screws extending through bearing ears on the swing arms extend into the bridge 32 and the machine chassis 10 along swing axes t transverse to the tool axis a and the rotation axis r of the drive motor 22. The rest of the pivots, namely the second pivots 40,42 of the upper swing arms 35,36 and the first pivots 43,45 of the lower swing arms 37,38 are formed by through axles 47 and 48, respectively, which are parallel with said pivot axes t and rotationally locked relative to the swing arms 35,36 and 37,38, respectively. The axles 37,38 are firmly vulcanized in cylindrical rubber bushes, or more precisely: two bushes 49,50 for the axle of the upper swing arms 35,36 and a single central bush 51 for the axle 48 of the lower swing arms 37,38. The bushes 49-51 are surrounded by retainers 52-54 for rotationally locking the bushes 49-51 to the machine chassis 10 and the bridge 32, respectively, such that the pivots 40,42,43,45 in question becomes torsion pivots which provides a limited torsion damped swinging of the bridge 32 relative to the machine chassis 10 substantially parallel to the tool direction a. In order to make this operate sufficiently smoothly and effectively the four swing arms 35-38 are of the same length and of course parallel to each other. In an unloaded starting position, as shown in the drawings, the arms 35-38 occupy an angle of about 105° visavi the tool axis a away from the chisel support 11. Moreover, the pivots are arranged such that the first pivots 39,41 of the upper swing arms 35,36 as well as the second pivots 44,46 of the lower swing arms 37,38 are located in level with a plane parallel with the pivot axles t and cross the tool axis a, whereas the second pivots 40,42 of the upper swing arms 35,36 are displaced towards the rear side of the breaker tool 1 and the first pivots 43,45 of the lower swing arms 37,38 are displaced towards the front side of the breaker tool 1. The handles 3,4 are located on the right and left hand sides of the machine chassis 10, and in relation to the pivots the handles are disposed close to the first pivots 39,41 of the upper swing arms 35,36 on a line between the respective pivot 39,41 and the respective second pivot 44,46 of the second swing arms 37,38.

It is to be understood that above described breaker tool may be modified in different ways within the scope of the claims and that for example different motors and power transmission alternatives are possible.

The invention claimed is:

1. A breaker tool comprising:

a chassis, a motor mounted on the chassis, an impact mechanism driven by the motor and arranged to operate in a certain working direction, an enclosure surrounding at least the motor, and a handle device comprising two handles protruding from opposite sides of the enclosure, wherein said handles are vibration damped relative to the chassis via swing arms forming a flexible parallel movement providing connection between the chassis and the handle device, wherein the enclosure is rigidly attached to the chassis, wherein the handle device comprises a handle carrying bridge located inside the enclosure and extending transversely relative to the chassis, wherein the swing arms are pivotally connected to said bridge via first pivots and connected to the chassis second pivots, and wherein at least one of said first and second pivots is a torsion pivot which provides a limited torsion damped oscillation of said bridge in a direction substantially parallel with the working direction.

2. A breaker tool according to claim 1, wherein said torsion pivot comprises a cylindrical elastomeric bush having a mantle which is rotationally locked relative to the respective swing arm, and a core that is rotationally locked relative to the chassis and said bridge, respectively.

3. A breaker tool according to claim 1, wherein the torsion pivot comprises a cylindrical elastomeric bush having a core which is rotationally locked relative to the corresponding swing arm, and a mantle that is rotationally locked relative to the chassis and said bridge, respectively.

4. A breaker tool according to claim 1, wherein a first pair of parallel swing arms are arranged on opposite sides of the chassis, and a second pair of swing arms are arranged on opposite sides of the chassis, and wherein said pairs of swing arms are arranged on opposite sides of the handles in relation to the working direction.

5. A breaker tool according to claim 3, wherein at least one of said first and second pairs of swing arms is rotationally locked to a common rod which is rotationally locked relative to the core of the respective elastomeric bush.

6. A breaker tool according to claim 1, wherein the motor is a combustion engine, and a fuel tank is mounted on said bridge inside the enclosure.

7. A breaker tool according to claim 1, wherein the motor is an electric motor, and an electronic control box is mounted on said bridge inside the enclosure.

8. A breaker tool according to claim 7, wherein the electric motor is an electronically commutated permanent magnet motor including a motor shaft with a crank arm which is arranged to drive directly the impact mechanism of the breaker tool.

* * * * *